US006345403B1

(12) United States Patent
Nagle

(10) Patent No.: US 6,345,403 B1
(45) Date of Patent: Feb. 12, 2002

(54) METHOD OF BRIDGE CONSTRUCTION USING CONCRETE DIAPHRAGMS

(75) Inventor: Gordon A. Nagle, West Brunswick Township Schuylkill County, PA (US)

(73) Assignee: Schuylkill Products, Inc., Cressona, PA (US)

( * ) Notice: Subject to any disclaimer, the term of this patent is extended or adjusted under 35 U.S.C. 154(b) by 0 days.

(21) Appl. No.: 08/436,626

(22) Filed: May 8, 1995

(51) Int. Cl.[7] ..... E01D 21/00
(52) U.S. Cl. ..... 14/77.1
(58) Field of Search ..... 14/73, 74.5, 77.1, 14/6; 52/250, 223.8, 601

(56) References Cited

U.S. PATENT DOCUMENTS 4,042,991 A * 8/1977 Macy et al. ..... 14/77.1
4,710,994 A * 12/1987 Kishida et al. ..... 14/738
5,634,308 A * 6/1997 Doolan ..... 52/334

FOREIGN PATENT DOCUMENTS

WO WO 94/10389 * 5/1994

* cited by examiner

*Primary Examiner*—Gary S. Hartmann
(74) *Attorney, Agent, or Firm*—Jones, Tullar & Cooper, P.C.; Daniel A. Sullivan, Jr.

(57) ABSTRACT

The invention provides precast concrete diaphragms for placement between the longitudinal beams of a bridge. Ends of the diaphragms have pockets to receive concrete for tight joints between longitudinal bridge beams and the diaphragms. The longitudinal bridge beams are prestressed against the diaphragms. There is a plicable material between the beams and the diaphragram.

1 Claim, 7 Drawing Sheets

METHOD OF BRIDGE CONSTRUCTION USING CONCRETE DIAPHRAGMS

TECHNICAL FIELD

The present invention relates to concrete diaphragms for bridges.

BACKGROUND OF INVENTION

U.S. Pat. Nos. 3,794,433 and 3,906,687 of Morris Schupack show concrete diaphragms which are cast-in-place.

DISCLOSURE OF INVENTION

A disadvantage of cast-in-place diaphragms is that they require considerable field time to prepare, thus slowing bridge construction.

It is an object of the invention to accelerate the provision of diaphragms in bridge construction.

Other objects of the invention will become apparent from the remainder of this specification as set forth below.

The invention provides precast concrete diaphragms to accomplish the objects of the invention.

A number of developments of the invention improve on this basic concept. For instance, in preferred modes of the invention, the ends of precast diaphragms are provided with pockets which receive concrete or group to accommodate variations in the relative positions of the longitudinal bridge beams and make a tight fit between them and the diaphragms. And, the longitudinal bridge beams may be prestressed against the diaphragms, this development of the invention being useful in the case of cast-in-place diaphragms as well. Other important characteristics of the invention will become apparent in the remaining explanations below.

BRIEF DESCRIPTION OF THE DRAWINGS

FIG. 5A also contains extra details concerning the method of the invention.

MODES OF THE INVENTION

Figure 1:
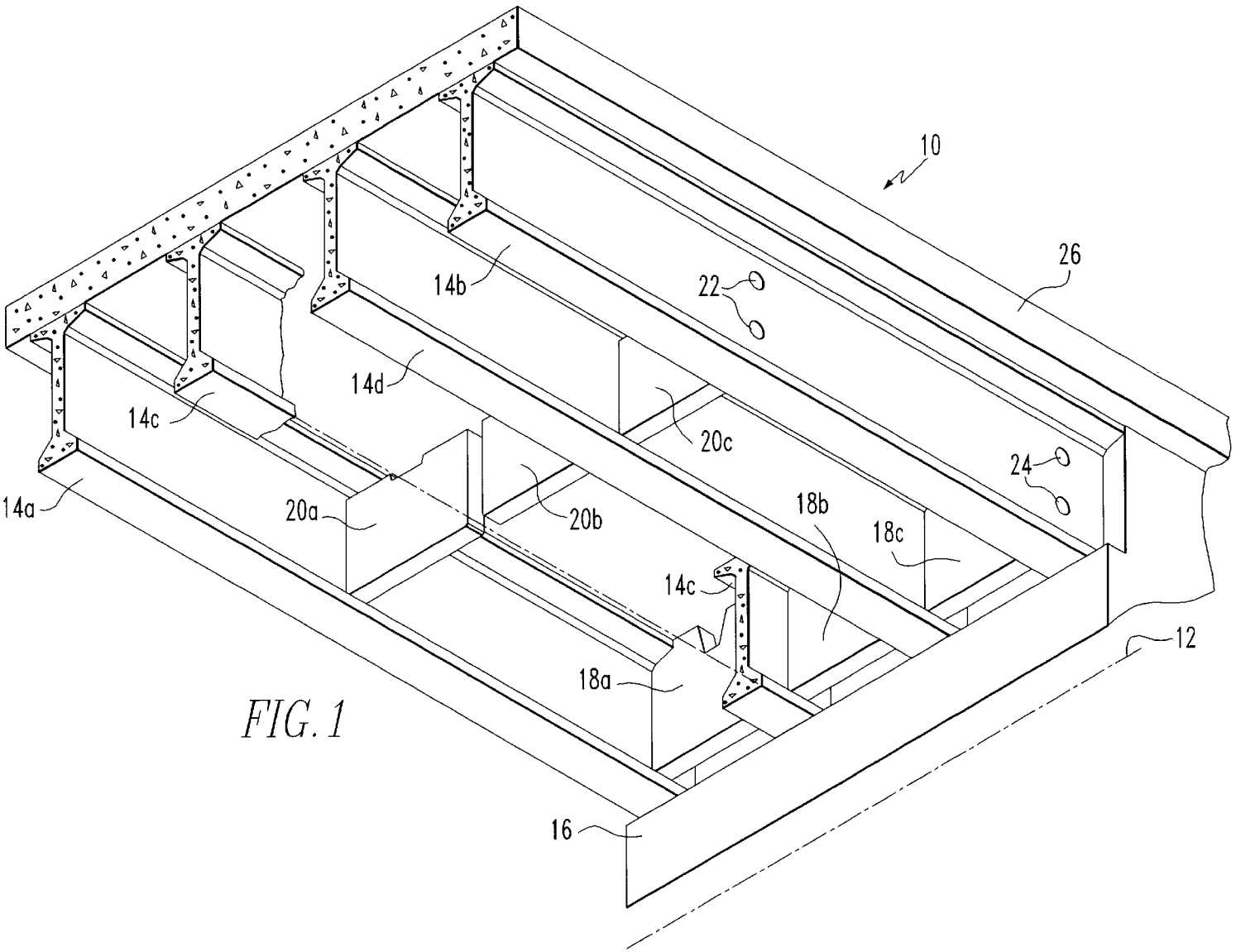
FIG. 1 is an isometric drawing showing a portion of the underside of a bridge.

FIG. 1 shows a bridge 10 constructed according to principles of the invention. The bridge is an overpass over a road indicated by road edge 12. The bridge of this example has four prestressed concrete I-beams extending in the longitudinal direction of the bridge. Of these beams, the two beams on the outside are fascia beams 14*a* and 14*b*, while the inside beams are intermediate beams 14*c* and 14*d*. These beams are referred-to collectively hereinafter as beams 14. The beams 14 rest at one end on reinforced concrete abutment 16 and on the other end (not shown), on a suitable opposing abutment, or on an intermediate abutment, in the case of a multispan bridge, such as over a divided highway.

Also shown in FIG. 1 are three precast concrete end diaphragms 18*a, b* and *c* (collectively, end diaphragms 18), and three precast concrete intermediate diaphragms 20*a, b* and *c* (collectively, intermediate diaphragms 20). The concrete of the diaphragms is reinforced, as will be brought out in more detail below. The diaphragms are connected in a prestressed assembly with the longitudinal beams, as indicated by the anchorage blockouts, or recesses, 22 and 24 visible in the web of the fascia beam 14*b*. The end and intermediate diaphragms strengthen the bridge and resist, for example, rotation of the longitudinal beams about their axes, when struck on their lower edge, for instance by an overheight truck.

Reinforced concrete bridge deck 26 is supported above the road and the road edge 12 directly by the assembly formed of the longitudinal beams 14 and the end diaphragms 18. Deck 26 does not contact the intermediate diaphragms 20, although they do contribute to reinforcement of the assembly which does directly support the deck.

The term "concrete" used here refers to the material of which the bridge members are made, namely cast and cured mixtures based on cement, usually Portland cement, and suitable aggregate. In general, this is "reinforced concrete", which means that the members are reinforced by the inclusion of steel reinforcing bar or welded wire fabric.

The term "precast" means that the members are manufactured in plants especially equipped for such purpose and then moved into place on the bridge. "Precast" is distinguished from "cast-in-place", or "in-situ" casting, where the members are made in forms placed where the members will remain when in service.

Figure 2:
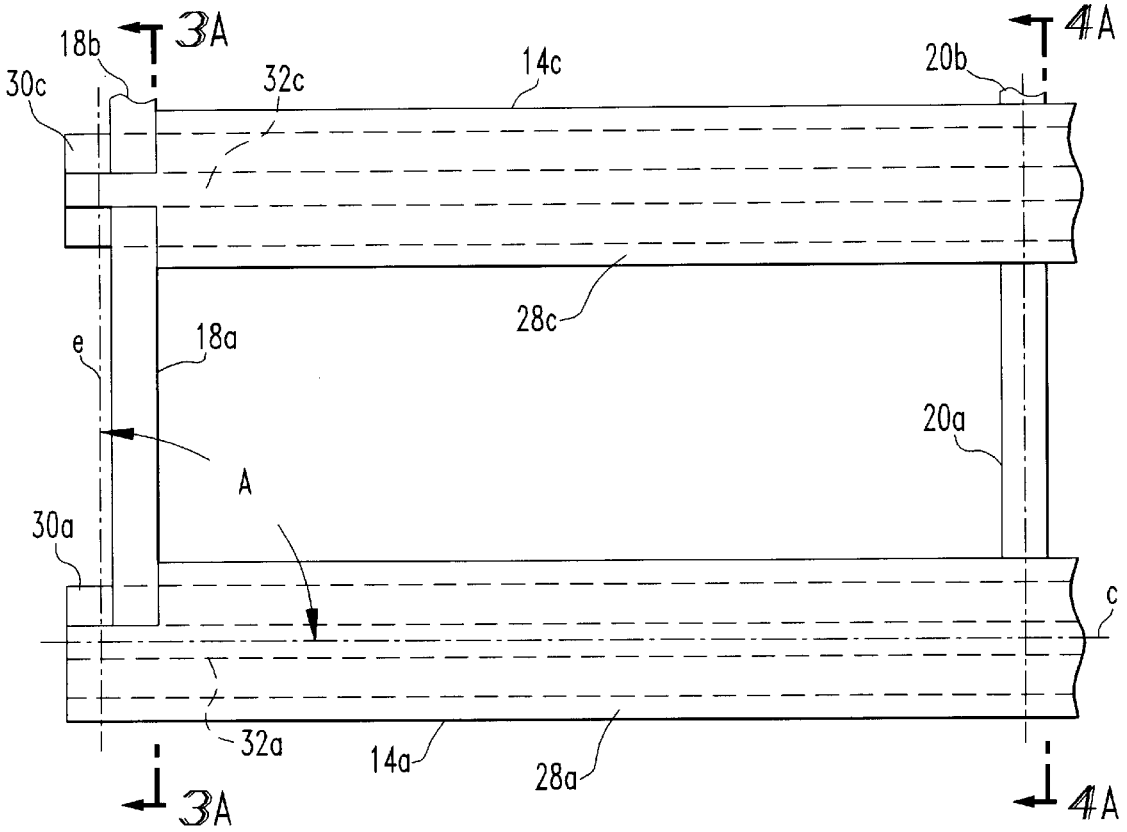
FIG. 2 is a top view of a portion of the bridge of FIG. 1, with the bridge deck removed to expose longitudinal beams and transverse diaphragms.

FIG. 2 is a top view of the far corner and side of bridge 10 as shown in FIG. 1. The correspondence between FIGS. 1 and 2 will be apparent from the numeric labels on the structural components in FIG. 2. FIG. 2 makes it clear that the bridge discussed here is a 90° bridge, in that angle A, i.e. the angle between the beam centerline, line c, and the nominal end of the bridge, line e, is 90°. The present invention is applicable as well to skewed bridges, where angle A is less than 90°. The bridge may, of course, skew the other way, in which case angle A is greater than 90°, but then the supplementary angle would be referred to as the angle of skew, so that bridge skew would be less than 90° in that case too.

FIG. 2 shows a difference in the interrelationship between the end diaphragms 18 and the beams 14, as compared to the situation between the intermediate diaphragms 20 and the beams.

In the case of end diaphragms, the beam upper flanges are partially blocked out, and the end diaphragms rise into the blocked out regions, along the beam webs and central portions of the upper flanges, essentially to the top of the beam. In the case of the intermediate diaphragms, the beam upper flanges above them are not blocked out, and the rise of the intermediate diaphragms is limited to the web portions of the beams.

The term "blocked out" is reference to the precasting process, where a block of wood or plastic is placed in a portion of the mold, to prevent the wet concrete from filling that portion. This leads to a cast product which has something missing, and the missing portion is said to have been "blocked out". The missing portion is referred to as a "blockout".

In FIG. 2, comparison of the solid and dashed, or hidden, lines shows, in the case of the fascia beam 14*a*, that the inside end of upper flange 28*a* has been blocked out, to make room for the rise of end diaphragm 18*a* along web 32*a* and then along the portion of flange 28*a* capping web 32*a*. Because of this blockout, the inside end of lower flange 30*a* is exposed, as indicated by the solid lines with which the inside end is drawn.

The situation for intermediate beam 14*c* and its relationship with the end diaphragms differs from that of a fascia beam, in that it has an end diaphragm on both sides. Therefore, both sides of the end of the upper flange 28*c* have been blocked out, so that only the central flange portion capping web 32*c* is left, and both sides of the end of lower flange 30*c* are exposed. This permits the rise of both end diaphragms 18*a* and 18*b* essentially to the top of beam 14*c*.

Turning attention now to the intermediate diaphragms 20*a* and 20*b* in FIG. 2, their joints with beams 14*a* and 14*c* remain covered by flanges 28*a* and 28*c*. The relationship of the end and intermediate diaphragms to the beams will become clearer on the basis of FIGS. 3A and 4A, respectively.

Figure 3B:
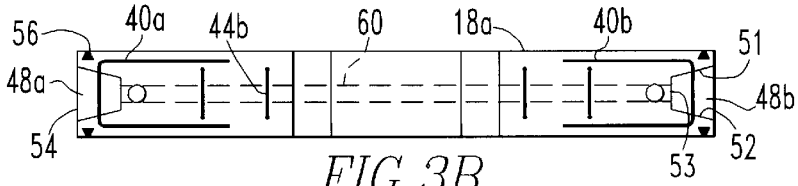
FIGS. 3B and 3C are views taken as shown by planes 3B—3B and 3C—3C of FIG. 3A.
Figure 3A:
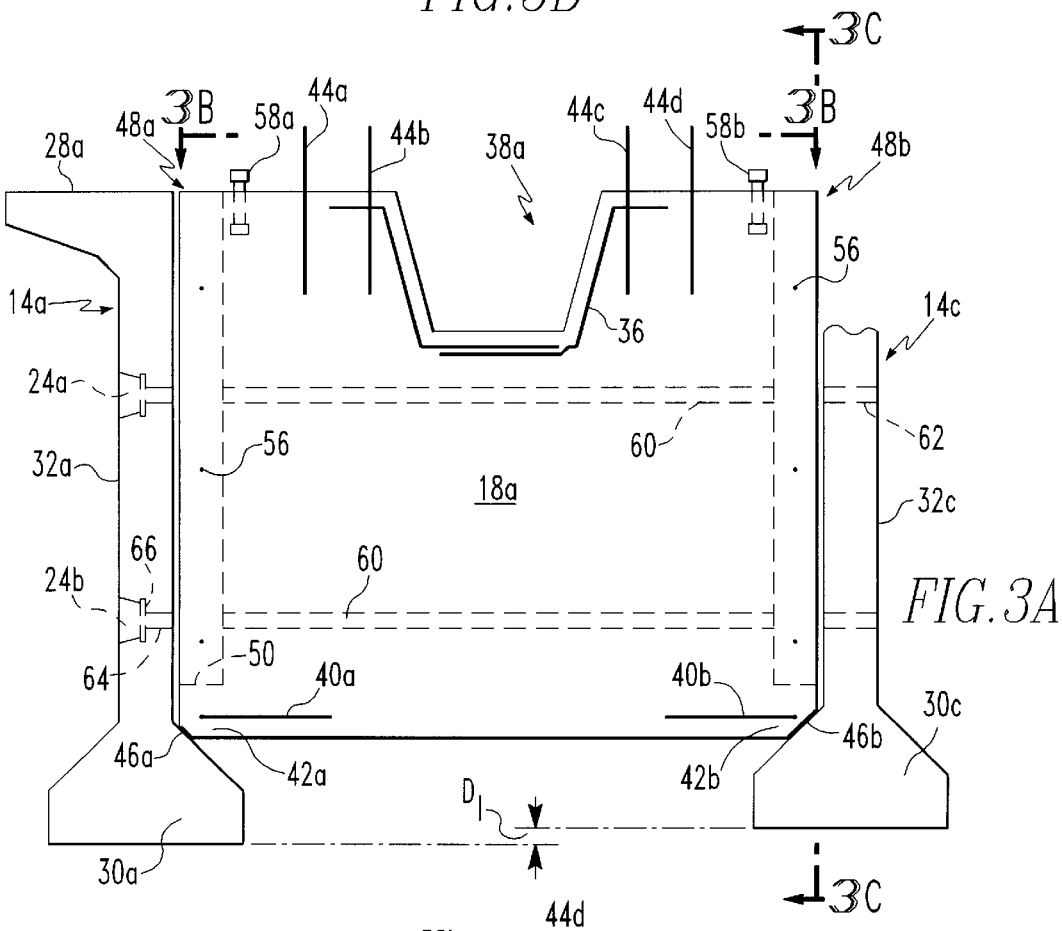
FIG. 3A is a view taken as shown by cutting plane 3A—3A of FIG. 2.
Figure 3C:
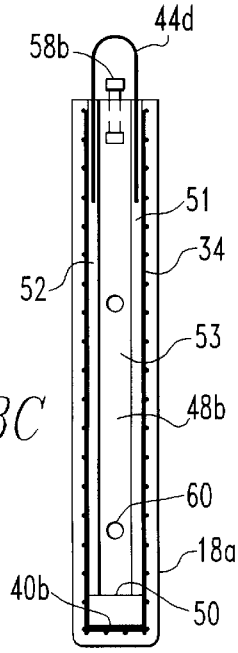

FIGS. 3A–3C show further detail for typical concrete end diaphragm 18*a* of the invention. FIG. 3A, in particular, provides further information on the relationship of diaphragm 18*a* to fascia beam 14*a* and intermediate beam 14*c*.

As shown in FIGS. 3A–3C, end diaphragm 18*a* contains several different steel reinforcements. In accordance with custom in the field of reinforced concrete, the reinforcement within the concrete is shown with heavy black lines. Thus, as apparent from FIG. 3C, the diaphragm is reinforced beneath its front, bottom, and hind surfaces with welded wire fabric 34. Bent reinforcing bar (rebar) 36 reinforces a utility blockout, or conduit, 38*a* (for gas, water, electrical, etc. lines) on the top surface of the diaphragm. Rebar stirrups 40*a* and 40*b* reinforce toes 42*a* and 42*b*, which are chamfered to match the slope of the upper surface of the lower flanges 30. Rebar stirrups 44*a–d* protrude from the top surface of the diaphragm to provide for an interlocking with the cast-in-place bridge deck 26 (FIG. 1).

In this example, FIG. 3A shows that beam 14*c* is higher than beam 14*a* by the elevational difference $D_1$, in order, for instance, to provide for slope, for instance a crown or superelevation, in the bridge deck 26. This elevational difference means that toe 42*b* must have a broader land in its chamfer than is the case for toe 42*a*. Land size is controlled by placing correspondingly dimensioned blackouts in the precasting mold. An elevational difference $D_1$ may occur for reasons other than to provide slope in the bridge deck; for instance, there may be different cambers in the beams.

Layers 46*a* and 46*b* of pliable material, for instance Styrofoam expanded polystyrene of Dow Chemical Co., Midland, Mich., are placed at the interface between the chamfers and the sloped upper sides of the lower flanges.

The chamfers and sloped upper sides of the lower flanges are inclined at 45°, in order to minimize the increased land size needed to accommodate differences in I-beam elevations. Use of chamfers and the matching slope on the upper sides of the lower flanges means that the diaphragms sit square when lowered into place; in contrast, if the upper sides of the lower flanges were flat, the diaphragms would cock in cases of $D_1>0$.

Diaphragm 18*a* additionally has pockets 48*a* and 48*b* at its ends, on its end surfaces. These pockets are hidden in FIG. 3A and, therefore, shown by dashed lines. The pockets each have a floor 50, but are open on top. As shown in FIG. 3B, the pockets have a trapezoidal cross section, which is essentially constant with height (FIG. 3C). The pockets have two side walls 51 and 52 of equal slope in FIG. 3B, but one positive and the other negative, a back wall 53, and are open on the base 54 of the trapezoid. All of the diaphragms shown in FIG. 1 have these pockets, which are referred to collectively hereinafter as pockets 48.

In this example of the diaphragm 18*a*, there are a series of 12 plastic inserts 56 arranged at the two ends of the diaphragm, 6 inserts on the front surface of the diaphragm and 6 on the hind surface. These inserts are arranged in the mold during the precasting process and extend to the surface of the cast diaphragm. They provide holds for bolts used in the process of the invention, as will be explained below. Suitable inserts are ½ inch thermoplastic inserts, Catalog No. 12-234, of Pennsylvania Insert Corp., Spring City, Pa.

Lifting anchors 58*a* and *b* are placed in the top surface of diaphragm 18*a*, suitable examples being Swift Lift anchors P-52 SL of Dayton Superior Products Inc., Dayton, Ohio.

Diaphragm 18*a* has two, or more, ducts 60 for reception of prestressing strand, as will be explained below in the description of the process of the invention. These ducts are formed during the precasting process, for instance by placement of electrical metallic tubing in the mold. This tubing, which is chosen to have a suitable internal diameter to accommodate the intended prestressing strand, is left in the precast diaphragm, to become a part thereof.

Ducts 60 are intended to align with corresponding holes 62 through the intermediate longitudinal bridge beams and holes 64 through the fascia longitudinal bridge beams. Holes 64 open into fascia beam anchorage blockouts, or recesses, 24*a* and 24*b*, which have steel plate reinforcements 66 embedded in their floors. Particularly in the case of bridge deck tilt, i.e. $D_1>0$, attention must be given to forming the holes 62 and 64 at the proper elevation in the precasting of the I-beams which will serve as the longitudinal beams of the bridge.

Figure 4B:
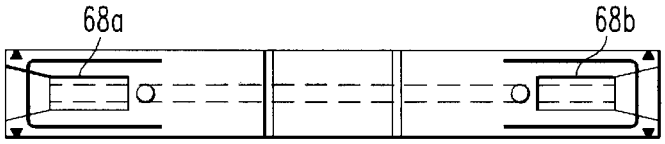
FIGS. 4B and 4C are views taken as shown by planes 4B—4B and 4C—4C of FIG. 4A.
Figure 4A:
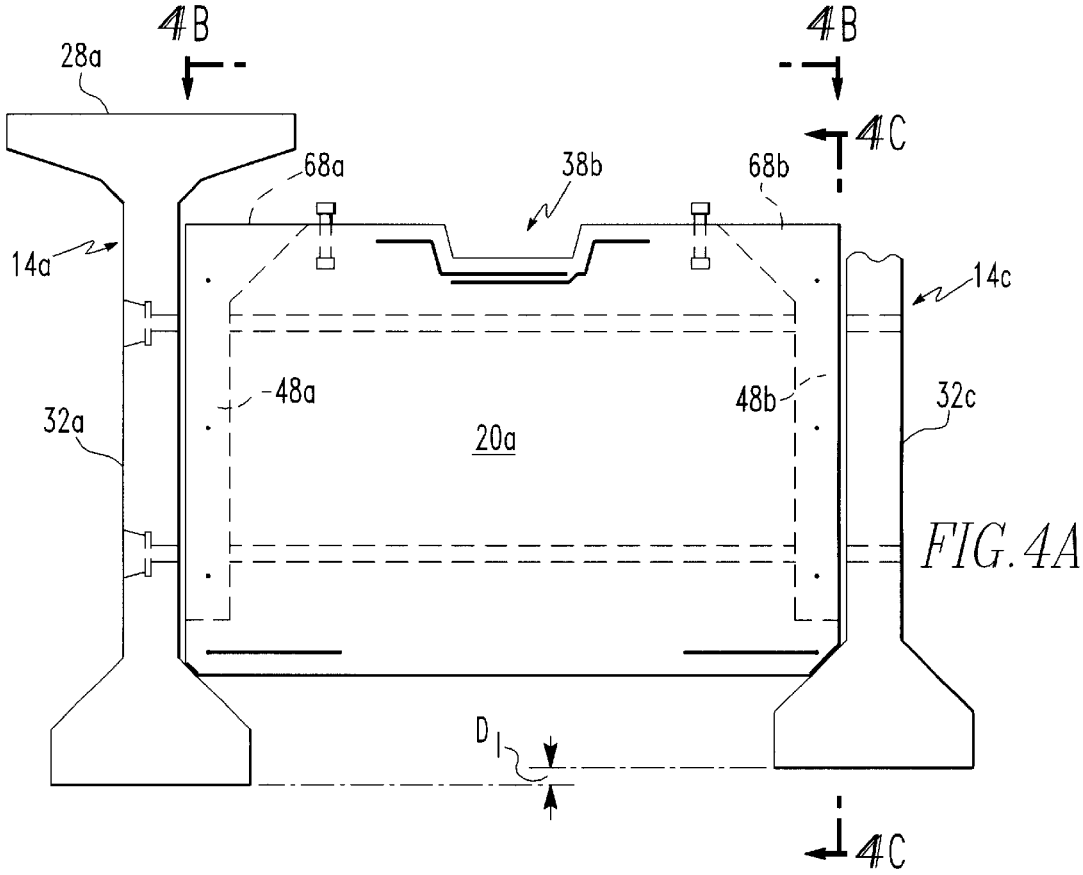
FIG. 4A is a view taken as shown by cutting plane 4A—4A of FIG. 2.
Figure 4C:
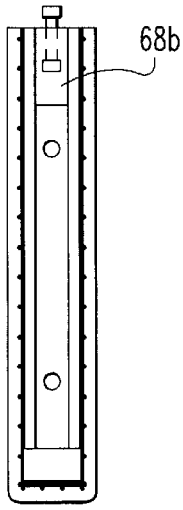

FIGS. 4A–4C illustrate a typical intermediate diaphragm 20*a* of the invention. It will be apparent to those skilled in the art, by comparison of FIGS. 4A–4C with FIGS. 3A–3C, that most features of the intermediate diaphragm are the same as for the end diaphragm.

Therefore, attention will be paid here only to the differences.

Intermediate diaphragm 20*a* rises only along the beam webs 32*a* and 32*c*, and the upper flanges 28*a* and 28*c* (flange 28*c* has been cut away from FIG. 4A, but is shown in FIG. 2) of the I-beams are not blocked out. Due to the lesser height of the intermediate diaphragm, utility conduit 38*b* is shallower than the conduit 38*a* of the end diaphragm. And, the tops 68*a* and 68*b* of pockets 48*a* and *b* flare toward the top surface of the diaphragm, to provide access to the pockets beneath the upper flanges, to aid in carrying out the methods of the invention, to be described below.

A method of bridge construction according to the invention will now be described with the help of FIGS. 5A-8. In the method, the longitudinal beams are first laid on the bridge abutments. The precast concrete diaphragms are next brought into place between the beams, resting on the upper sides of the lower flanges, with interposed pliable layers, as shown in FIGS. 3A and 4A. In the case of end diaphragms, because of the upper flange blockouts, the diaphragms can be lowered by a crane directly down, into place. For the intermediate diaphragms, it is necessary to lower them rotated out of position, in order that they miss the upper flanges of the beams, and then rotate them back into their final position, crossways to the beams.

During this initial positioning, attention must be paid to assure that the prestressing strand ducts in the diaphragms align with the holes in the beam webs. In general, alignment is to be expected, because beams and diaphragms will have been prefabricated, precast, on the basis of engineering drawings for the particular bridge being built. However, working tolerances may lead to some need for calculated insertions of shims or wedges into the structure, in order to achieve alignment.

Figure 5B:
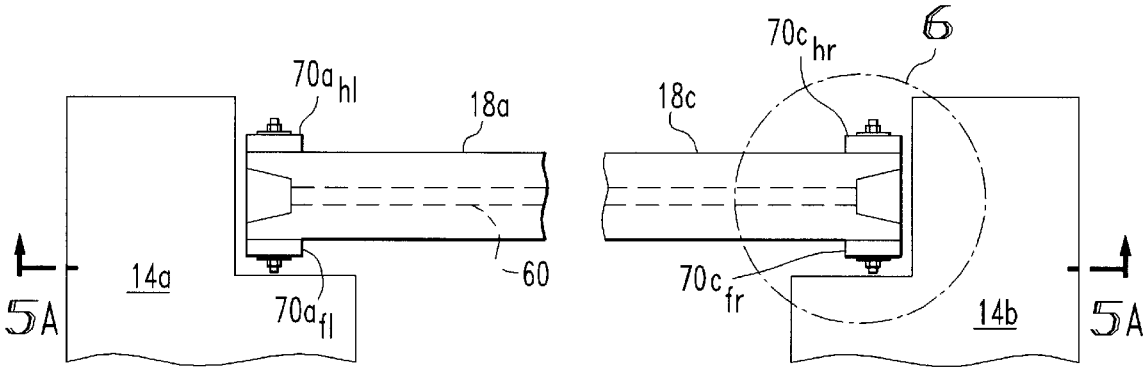
FIG. 5B is a top view of FIG. 5A.
Figure 5A:
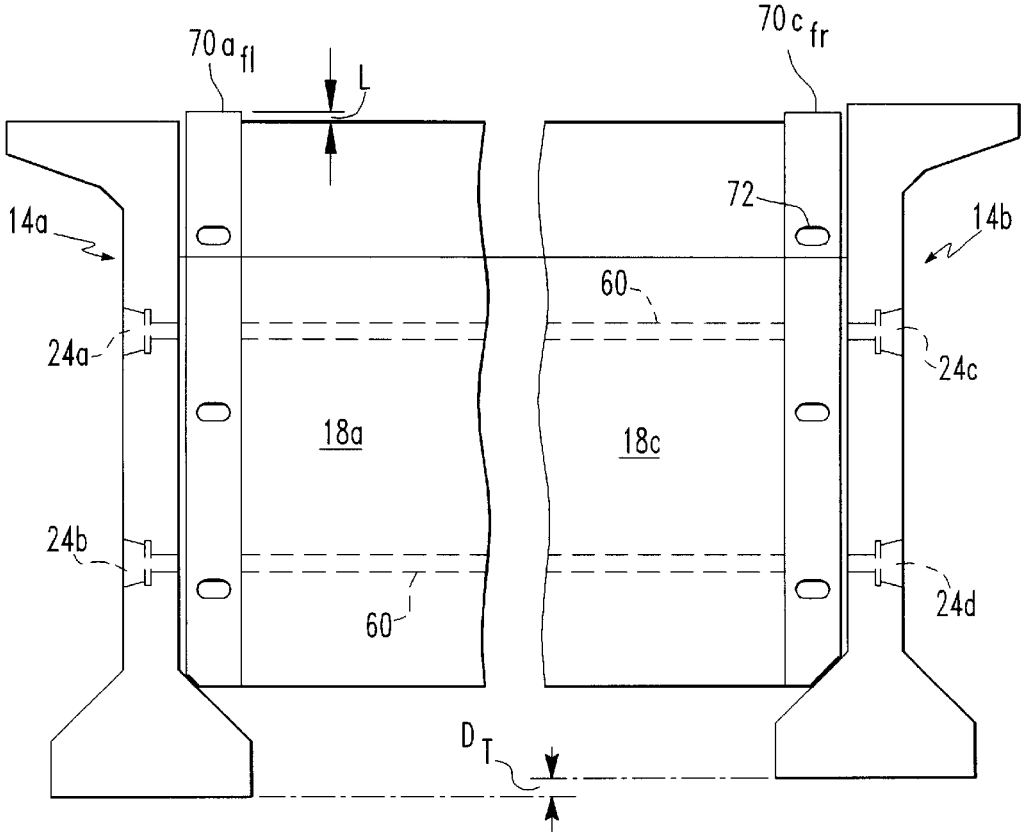
FIG. 5A is a view taken with the cutting plane 3A—3A of FIG. 2, but extended to include also the fascia beam on the other side of the bridge. All intermediate beams have been cut away.

The dimension between the extremes of the two ends of each diaphragm, relative to beam spacing, is chosen such that a gap of, for example, one inch will remain between each diaphragm end and the web of the bridge beam which the end faces, when the diaphragm is set down in place. Then adjustable, wooden forms are attached to the diaphragms, to assist in closing the gaps. FIGS. 5A and 5B show the stage reached in the method at this point.

FIGS. 5A and 5B display from FIG. 1 the fascia beams 14*a* and 14*b* and the end diaphragms 18*a* and 18*c*. Ducts 60 are aligned with holes 64 and blockouts 24*a–d*. Wooden forms $\mathbf{70}a_{fl}$, $\mathbf{70}a_{hl}$, $\mathbf{70}c_{fr}$ and $\mathbf{70}c_{hr}$ are shown in place in FIGS. 5A and 5B. The labeling system used in the previous sentence for the wooden forms, collectively wooden forms 70, is determined as follows: the initial, non-subscripted letter equals the letter designation of the particular end diaphragm 18 that the form is attached to, and the subscripts "f", "h", "l", "r" and first mean, respectively, "front", "hind", "left", and "right".

There are a number of wooden forms not shown in FIGS. 5A and 5B which can be discussed using this labeling system. For instance, the right side of diaphragm 18*a* will carry forms $\mathbf{70}a_{fr}$ and $\mathbf{70}a_{hr}$, and the left side of the diaphragm 18*b* (cut away from FIGS. 5A and 5B) will have on its left end the forms $\mathbf{70}b_{fl}$ and $\mathbf{70}b_{hl}$.

Additionally, there is a set of shorter wooden forms (not shown) for the intermediate diaphragms 20.

FIG. 5B shows bolts and washers holding the wooden forms 70 in place, while, in FIG. 5A, they have been omitted, in order to expose the transversely elongated holes 72 in the forms. The transverse elongation of holes 72 provides a capability for adjusting the positions of the forms, for obtaining tight closure of the gaps between the diaphragm ends and the I-beam webs.

The length of the wooden forms 70 exceeds the height of the diaphragms by a small amount L, as shown in FIG. 5A, in order to assure that, in spite of tolerances, the forms will never be shorter than the diaphragm height. Forms of less than diaphragm height would mean that the pockets 48 could not be filled completely with wet concrete or group in a subsequent method step to be described below. The lower ends of the forms 70 are chamfered to match the slope of the upper sides of the lower flanges of the beams.

The elevational difference $D_T$ shown at the bottom of FIG. 5A is the total of the difference $D_1$ and the other differences from beam to beam, as one goes from left to right across the bridge. In the case where the bridge has a constant tilt, or superelevation, across its width and the beams all have equal spacings, one from the other, all the elevational differences between neighboring beams will be equal to $D_1$, and there will be need for only two kinds of wooden forms for the end diaphragms, a left form $\mathbf{70}_1$ and a right form $\mathbf{70}_r$ (FIGS. 7A and 7B), and two kinds (not illustrated) for intermediate diaphragms. If there is no elevational difference between the beams, the chamfer land size at the lower end becomes the same on both sides, left and right, and then only one kind of form is needed for end diaphragms and one for intermediate diaphragms.

Figure 6:
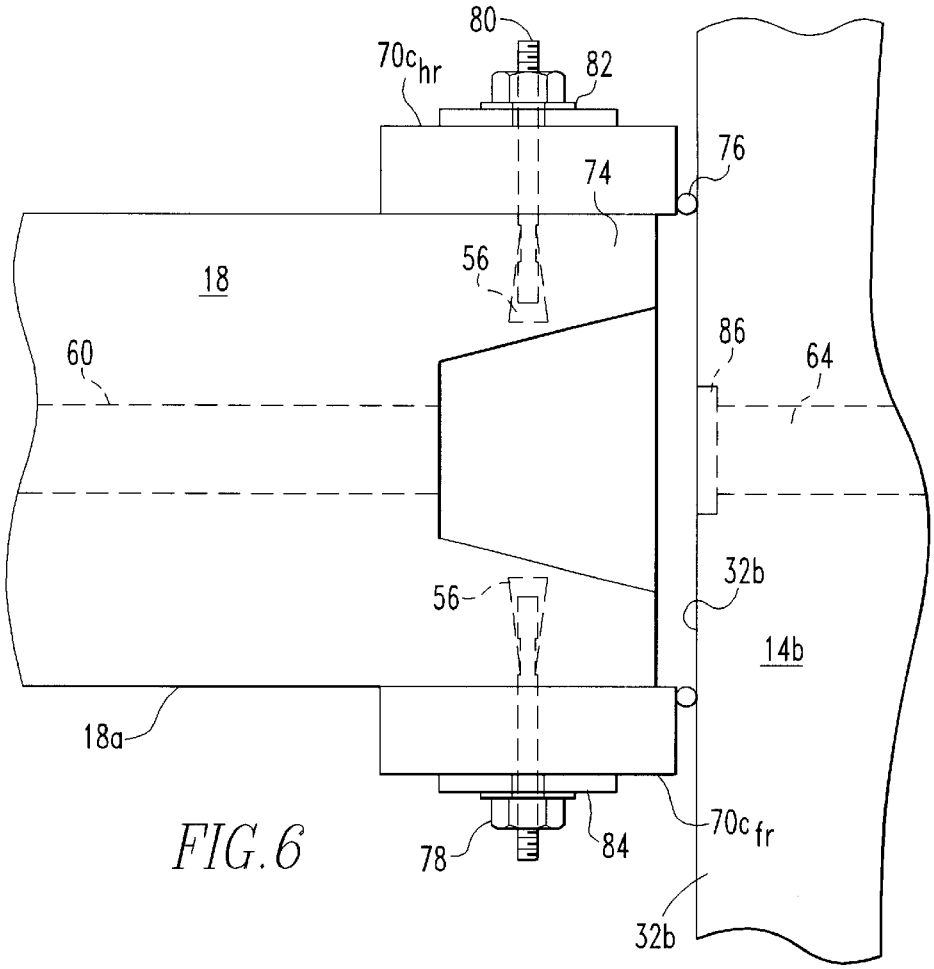
FIG. 6 is a detail view of the region within circle 6 of FIG. 5B.
Figure 7A:
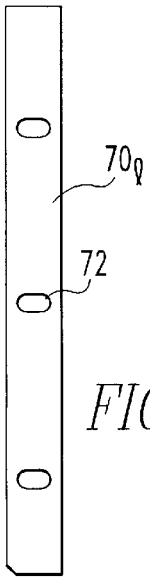
FIGS. 7A and 7B show a portion of the structure of FIG. 5A.
Figure 7B:
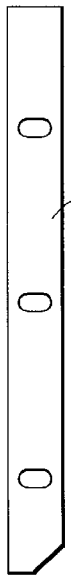

FIG. 6 shows in greater detail the seal between end 74 of diaphragm 18*c* and the web 32*b* of the beam 14*b*. Wooden forms $\mathbf{70}c_{hr}$ and $\mathbf{70}c_{tr}$ have been pushed into squeezing relationship against seal rods 76 and locked in place by tightening of the nuts 78 of bolts 80 (held in inserts 56) against plain washers 82 and plate washers 84. An example of suitable sealing rods 76 are those of Ethafoam plastic foam, produced by Dow Chemical Co. of Midland, Mich.

FIG. 6 shows an optional feature in the form of a keyway, or blockout, 86 on the web 32*b* of beam 14*b*. This keyway, which may be, for example, twice as high as its breadth (breadth is measured vertically in FIG. 6, while height is measured perpendicular to the plane of FIG. 6), is centered on hole 64. Keyway 86 has a depth of, for example, ½ inch into the web, for the purpose of receiving concrete or group, in the casting step of the method as described below, to increase the shear strength of the joint. It may be desirable to use this optional feature particularly in the case of bridges which have significant skew, for instance for cases where the angle of skew is less than 75°.

The sealing shown in FIG. 6 is carried out for all end diaphragms 18 and all intermediate diaphragms 20. Then, prestressing strand is placed through the aligned ducts 60 in the diaphragms and holes 62 and 64 in the beams. While the example of the drawings shows ducts and holes for two strands per course of diaphragms, for beams over 63-inches deep, three sets of ducts and holes are used, in order to have three strands, or tendons, for bigger beams.

A suitable strand is ½ inch diameter Polystrand tendon, Designation No. 41K, of Lang Tendons, Inc., Toughkenamon, Pa. This strand advantageously has a polypropylene outer sheath over a 7wire steel strand which has been coated and impregnated with grease. The steel strand slides within the sheath during the post-tensioning to be described below.

Figure 8:
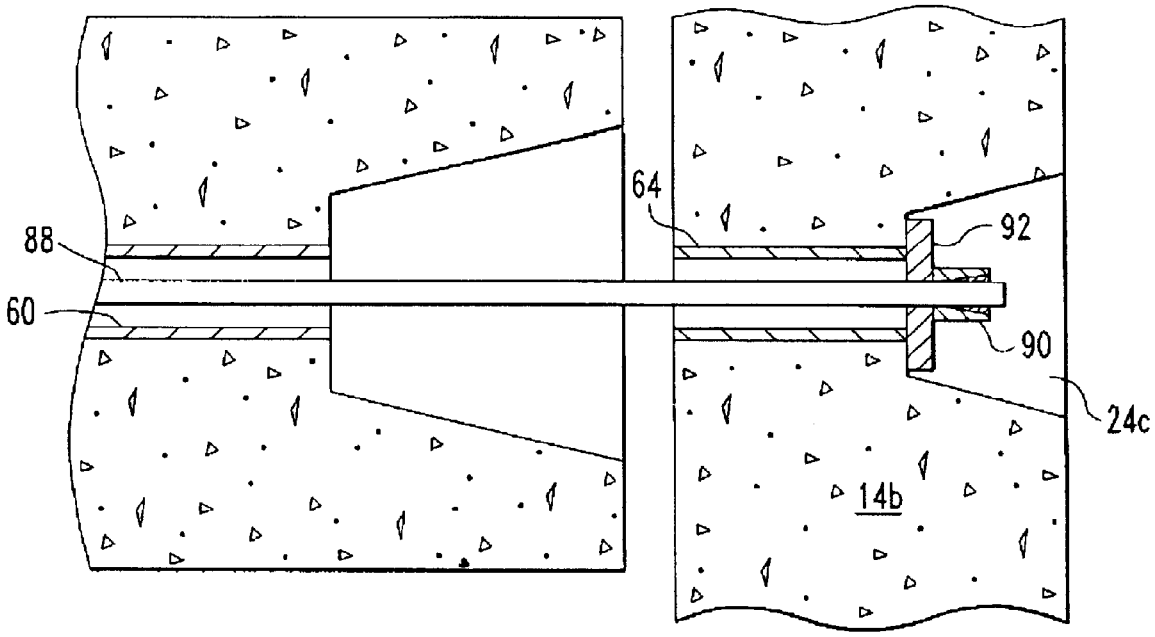
FIG. 8 is a view similar to FIG. 6, but emphasizing a further step in the method of the invention.

FIG. 8 is a detail view like FIG. 6 but adapted to emphasize the portion of the method involving the placing of a pre-stressing stand 88 in aligned duct 60 and hole 64. In this case, the sleeve, or electrical metallic tubing, used to form these passageways, is shown by cross sectioning. The strand end in fascia beam 14*b* is anchored in place with a one-time-use chuck 90 bearing against a plate 92 on the floor of blockout 24*c*. The other end of the strand, exiting anchorage blockout 24*a* (FIG. 5A), is kept long, for instance an extra 3-feet of strand extending beyond fascia beam 14*a*, so that there is extra strand to work with during the strand tensioning step, which is done later.

The anchorage blockouts 24 are next sealed, or plugged, for instance with Styrofoam expanded polystyrene, to keep the anchored ends of the prestressing strands in place and to center their loose ends, and to prevent leakage of wet concrete or group in the casting step.

Pockets 48 are next filled with wet concrete or group in the casting step of the method. The wet concrete or group is tamped or vibrated to fill the internal cavities formed by the pockets, the wooden forms, and the beam webs. The flared tops 68*a* and 68*b* of the pockets in the intermediate diaphragms provide access for pouring spouts for the wet concrete and for vibrating equipment:

underneath the beam upper flanges. Leakage of the wet concrete is prevented by the sealing rods 76 and the pliable material 46. A small amount of the concrete or group may bulge into the ducts 60. Pliable material 46 thus serves a dual purpose, both as a seal and as a cushion between the diaphragms and the upper sides of the lower flanges of the beams.

A suitable material for use in the casting step is Class AA concrete, per ASTM Specification No. C94-86, with maximum coarse aggregate size of ⅜-inches.

After the cast material has cured, the wooden forms 70 and the anchorage blockout seals are removed.

Next, the prestressing strands 88 are tensioned, for instance to a level of 30,000 pounds. This causes a some slippage of the steel wires of the strand relative to the plastic sheath which is in contact with the now cured concrete cast. Alternatively, or perhaps concurrently, the movement may lead to some deformation of the plastic sheath, or there may be slippage at the interface between the sheath and the cured concrete.

Strand chucks 90 and similar chucks (not shown) on the opposite fascia beam 14*a* hold the tension level reached in the tensioning. The fascia beams press against the cast joints of the casting step and adjoining diaphragms, and this pressure is transferred right across the bridge, so that the diaphragms become connected with the longitudinal beams in one entire prestressed assembly.

Suitable equipment for carrying out the tensioning include a ram and jack, for instance a centerhole ram and pump combination set available from OTC Power Team Industrial Division of Owatonna Tool Company, SPX Corp., Owatonna, Minn.

The tensioning step described in this preferred mode of the invention is a post-tensioning prestressing, in that the tensioning is done after the concrete in the joint has cured. Alternatively, however, the tensioning may be done before the casting, or even immediately after the casting, before the concrete has cured, provided that the gaps between the diaphragm ends and the beam webs are held open, for example by suitable steel spacers.

Following tensioning and removal of the tensioning equipment, the excess strand length is cut off and the anchorage blockouts in the fascia beams are filled with a suitable non-staining, non-shrink group.

As compared to bridge construction using cast-in-place diaphragms, construction using the precast diaphragms of the invention is considerably faster. For cast-in-place diaphragms, forms for the entire diaphragms must be assembled on the bridge between the longitudinal beams. Then, steel reinforcement has to be put in place in those forms. Following that, all of the concrete for the diaphragms has to be poured (cast), vibrated, and allowed to cure. In contrast, in the case of the precast diaphragms of the invention, all that work has already been done; they need only be lowered into place and their relatively small joints with the beams prepared.

Figure 9:
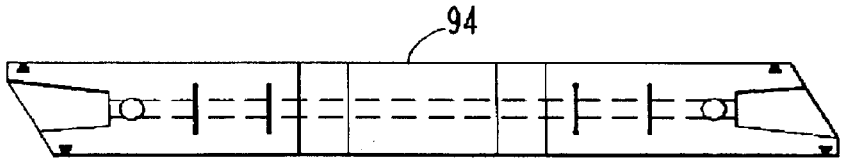
FIG. 9 is a view as in FIG. 3B of a modified diaphragm.

As noted above, the invention is applicable, as well, to skewed bridges. In a skewed bridge, line e in FIG. 2 representing a nominal end of the bridge closes toward line c, the centerline of fascia beam 14*a*, so that angle A becomes less than 90°. The longitudinal beams are still parallel to one another, but the beams are progressively shifted to the right in FIG. 2 as one progresses across the bridge from fascia beam 14*a*. The end diaphragms join with the beams at the angle A<90°. FIG. 9 shows an end diaphragm 94 with ends appropriately slanted to take this into consideration. The intermediate diaphragms may extend either perpendicularly to the beams or at angle A; which choice is made will depend, in general, on the engineering details of the support desired for the structure.

The above explanations of modes of the invention are to be understood in the sense of examples. Various changes can be made without departing from the spirit and scope of the invention as defined by the claims set forth below and the range of equivalence allowed by law.

What is claimed is:

1. A method of bridge construction, comprising the steps of placing a precast concrete diaphragm with an end facing a longitudinal beam of a bridge and casting a joint of concrete or group between the end and the beam, the beam being an I-beam, the step of placing including resting the diaphragm on an upper side of a lower flange of the I-beam, the step of placing further including interposing a pliable material between the diaphragm and said upper side.

* * * * *